US005927225A

United States Patent [19]

Jeter et al.

[11] Patent Number: 5,927,225

[45] Date of Patent: Jul. 27, 1999

[54] ASSEMBLY AND METHOD FOR COUPLING AT LEAST TWO MARINE VESSELS TOGETHER AND CONDUCTING FLUIDS BETWEEN THEM

[75] Inventors: Howard Ray Jeter, Westmoreland, Pa.; Larry Burns Kincaid, Orlando, Fla.; Theodore Daniel Biss, Wyomissing; Alexander Todd Colton, Pleasant Hills, both of Pa.

[73] Assignee: Siemens Westinghouse Power Corporation, Orlando, Fla.

[21] Appl. No.: 08/946,740

[22] Filed: Oct. 9, 1997

[51] Int. Cl.[6] ..... B63B 21/00

[52] U.S. Cl. ..... 114/230.1; 441/4

[58] Field of Search ..... 414/137.9, 138.1, 414/139.9; 114/230; 441/3–5; 137/615; 141/250; 285/24

[56] References Cited

U.S. PATENT DOCUMENTS 3,910,609 10/1975 Van Der Gaag ..... 441/3
4,281,611 8/1981 Vilain ..... 441/5
4,786,266 11/1988 Fozard et al. ..... 441/5
4,867,211 9/1989 Dodge et al. ..... 441/4

*Primary Examiner*—Stephen Avila

[57] ABSTRACT

An assembly and method for conducting high temperature fluids between two marine vessels is provided. The assembly comprises a coupling member for coupling the two vessels together thereby allowing free rotational movement but controlled translational movement of each vessel relative to the other. Preferably, the coupling member comprises two pair of rigid legs, wherein one end of each leg of each pair is affixed to a different one of the vessels and the free ends of each leg of each pair are joined together with a joint member for pivotably joining the legs, and thus the vessels. The assembly further comprises a rigid conduit for conducting the fluids between equipment located on each of the vessels, and support members for supporting opposing ends of the conduit above each of the vessels, such that the conduit traverses a space created between the vessels by the coupling member. The movement of the vessels is accommodated either by flexibility in the support members or by comprising the rigid conduit of two ducts and connecting the ducts with an expansion joint, positioned in the space between the vessels, designed to accommodate the movement between the vessels.

21 Claims, 5 Drawing Sheets

ASSEMBLY AND METHOD FOR COUPLING AT LEAST TWO MARINE VESSELS TOGETHER AND CONDUCTING FLUIDS BETWEEN THEM

FIELD OF THE INVENTION

The present invention relates to a ducting system for conducting high temperature fluids between equipment located on more than one marine vessel. More specifically, the invention relates to a ducting structure in which two marine vessels are coupled together to minimize the translational movement of each vessel relative to the other and in which a conduit structure, capable of accommodating the relative movement of the vessels, conducts fluids between equipment located on the two vessels.

BACKGROUND OF THE INVENTION

Ducting systems are used in all sorts of processes, particularly in power plants, for transmitting fluids from one location, or piece of equipment, to another. If the fluids conducted by the conduit of the ducting system are sufficiently high temperature, certain materials and construction are unsuitable for use as the conduit in the application. In those cases, the conduit used must be dynamically rigid with respect to inertial loads, but flexible with respect to foundation movement and thermal expansion of the connected equipment and the conduit itself.

A problem occurs when high temperature fluids, requiring a dynamically rigid conduit, must be conducted between equipment that is not immobile, particularly if the movement of the various pieces of equipment is independent of each other. Processes, such as power generation, often require transport of energy in the form of hot and/or pressurized fluids from one piece of equipment to another. There is often relative movement between this equipment and expansion of the conduit because of the increased temperature. When the various pieces of equipment are located on two or more floating vessels, the problem of relative movement is further complicated by the motion of the vessels due to wind and wave forces and/or changes in the center of gravity of the vessel(s) due to plant operation and/or maintenance. Because the conduit must be dynamically rigid, the relative vessel motion must be controlled within acceptable and predictable limits to avoid imposing unacceptable forces and moments on the rigid conduit. The vessel coupling structure, the conduit and the support system for the conduit, therefore, must be capable of allowing some motion between the vessels while avoiding excessive stress from being applied to the conduit.

SUMMARY OF THE INVENTION

The present invention is an assembly and method for coupling at least two marine vessels together and conducting high temperature fluids between them. The invention comprises a coupling member for pivotably coupling the facing ends of the marine vessels together, such that the translational movement of each vessel relative to the other is controlled. The invention further comprises a rigid conduit for conducting fluids between the vessels, and support members for supporting opposing ends of the conduit on each of the vessels. The preferred coupling member comprises two pair of rigid legs, wherein an end of each leg of each pair is affixed to a different corner of the facing ends of the two vessels, and two joint members connect the free ends of each leg of each pair together thereby controlling the translational movement of the vessels relative to each other.

The preferred conduit consists of at least two rigid, hollow ducts, wherein at least one expansion joint connects the two ducts together at a location between the two vessels so that the expansion joint prevents the movement of the vessels from applying stress on the rigid, hollow ducts. A preferred use for the novel assembly and method of the present invention is an exhaust ducting system for use with a two barge mounted combined cycle power plant consisting of combustion turbines on one barge and heat recover stream generators (HRSG) and a steam turbine on the second barge.

BRIEF DESCRIPTION OF THE DRAWINGS

A full understanding of the invention can be gained from the following description of the preferred embodiment when read in conjunction with the accompanying drawings in which.

DETAILED DESCRIPTION OF THE INVENTION

A method and system that overcome the above-mentioned problems associated with conducting high temperature fluids between equipment located on more than one marine vessel are described below with reference to the figures. Those skilled in the art will readily appreciate that the description given herein with respect to the figures is for explanatory purposes only and is not intended in any way to limit the scope of the invention. Also, common reference numbers are used throughout the drawings to represent common elements. All questions regarding the scope of the invention should be resolved by referring to the appended claims.

Figure 1:
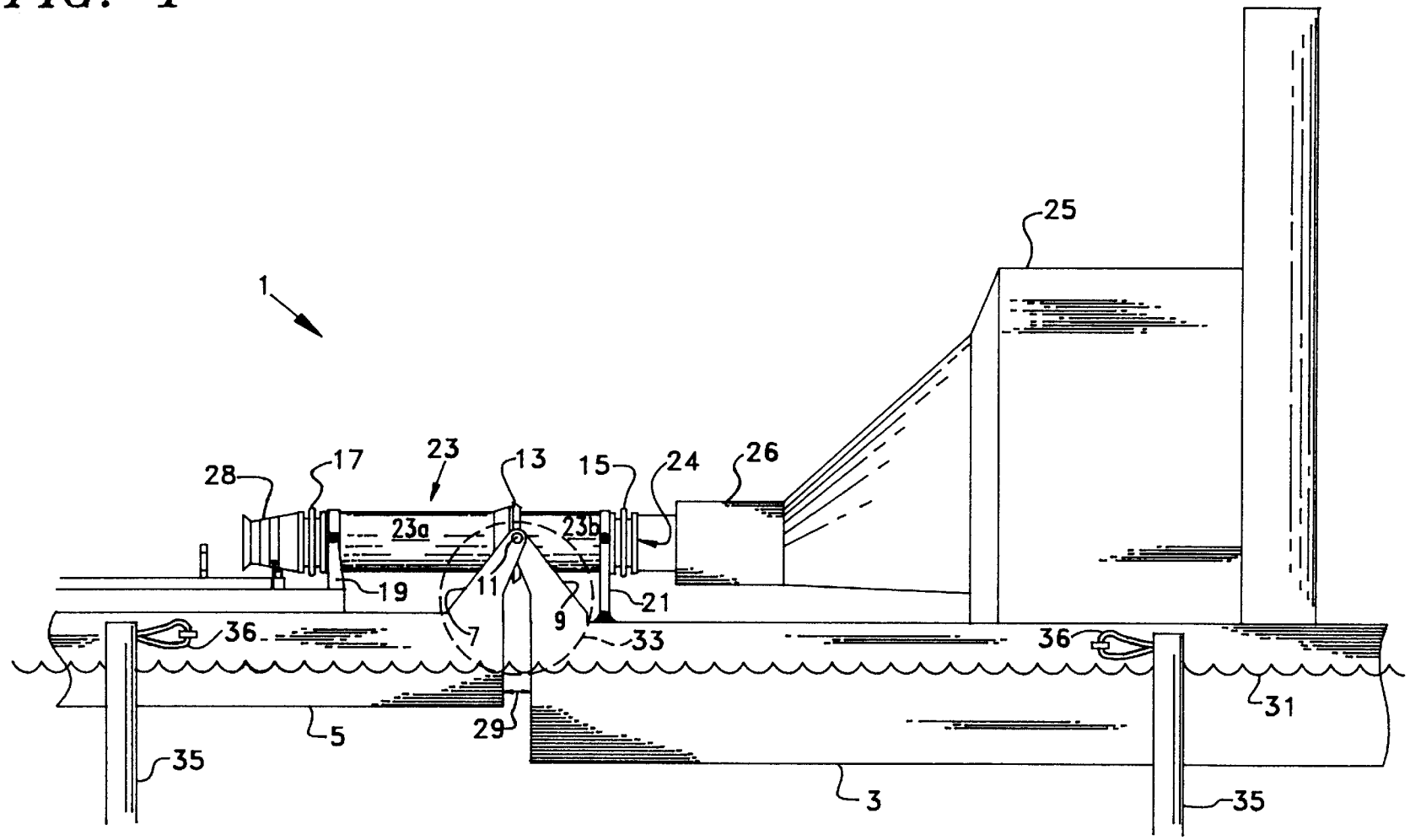
FIG. 1 schematically illustrates an assembly for coupling at least two marine vessels together and for conducting fluids between them according to the invention.

Referring now to the figures, FIG. 1 shows a two vessel power plant 1 utilizing the assembly and method of the present invention. In the figure, which represents a preferred embodiment of the present invention, the two vessels are barges, here a combined cycle barge 3 and a simple cycle barge 5. Located on the simple cycle barge 5 are combustion turbines 27 (not shown) or some other equipment which can store or utilize fluids. On the combined cycle barge 3, is a steam turbine (not shown) and heat recovery steam generators (HRSG) 25, or, again, any type of equipment that either stores or utilizes high temperature fluids.

Figure 5:
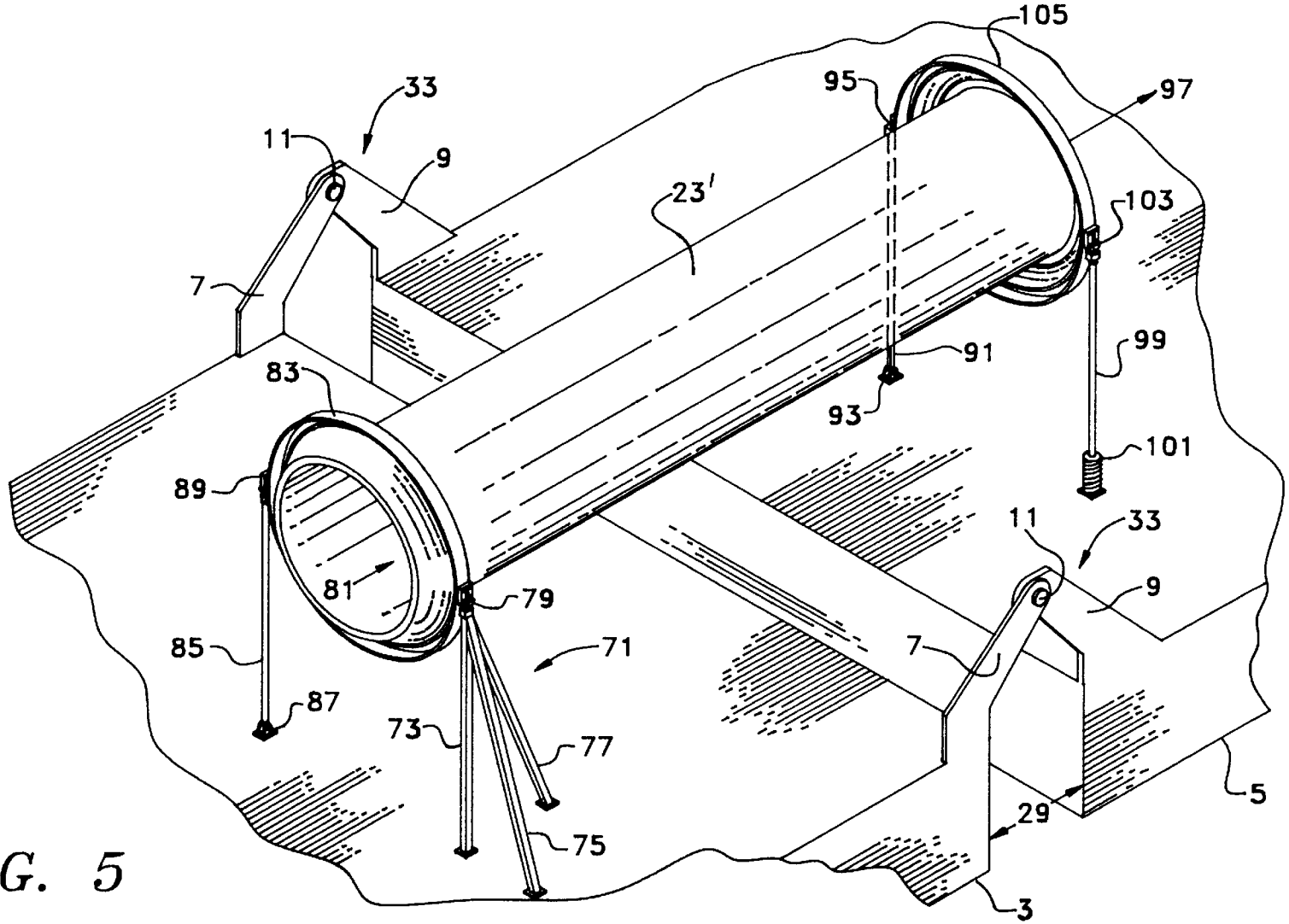
FIG. 5 is a perspective view of a coupling member for coupling two marine vessels together, and also, illustrates another embodiment of the conduit and support structures of the present invention.

The ducting assembly of the present invention is designed to accommodate the differential movement of the two barges and the thermal expansion of the equipment 25, 27 to and from which the fluid is being conducted. The ducting assembly is designed so that a basically rigid conduit 23 may conduct fluids from, for example, the combustion turbines 27 on the simple cycle barge 5 to the HRSG 25 on the combined cycle barge 3. In order to reduce the movement between the barges caused by waves, wind and other factors, the facing ends of the barges must be coupled together. The coupling member 33, in the preferred embodiment, comprises a first leg 9 which is affixed to one of the barges, here the combined cycle barge 3. A second leg 7 is affixed to the other barge, here the simple cycle barge 5. In a preferred embodiment, the first leg 9 is welded to the barge and the second leg 7 is bolted. However, any means of rigidly affixing the legs to the barges may be used. Then, the two legs are joined together by a joint member 11, which permits free rotational movement but controlled translational movement of each vessel relative to the other. In a preferred embodiment, there is an identical coupling member on the opposite side of the conduit 23 attached to the other facing corners of the barges, as shown in FIG. 5.

The coupling member provides a space 29 between the two barges. This space is generally about six feet, but will fluctuate slightly in distance as permitted by the movement of the coupling member and thus the differential movement of the barges. The barges will also be permitted to move together in the vertical direction, up and down, based on the tide changes. The spacing between the barges is important because, as is common, both barges are anchored, or moored, to pilings 35 embedded in the sea floor. In fact, in a preferred embodiment, each barge is anchored to two pilings 35, wherein two are located as shown in FIG. 1 and the other two pilings are located in substantially the same position with respect to each barge but on the opposite side of the barges. Each barge, in a preferred embodiment, is attached to the pilings by clamps 36 affixed to the side of the barge, which control the movement of the barges. The space 29 between the barges allows for fluctuation between the barges and allows the stress resulting from the movement of the barges to be applied to the clamps 36, rather than the coupling member 33. This minimizes the size and strength requirements of the coupling member 33 and the support members 19, 21 and thereby minimizes the cost.

In a preferred embodiment, the joint member 11 of the coupling member 33 is elevated above the water level 31 so as to be basically even with the horizontal centerline of the conduit 23. This lessens the amount of movement between the equipment 25, 27 which must be handled by the conduit 23.

The conduit 23, in a preferred embodiment, is formed by two or more rigid, hollow ducts, here the combustion turbine duct segment 23*a* and the HRSG duct segment 23*b*, joined together by a middle expansion joint 13. The ducts are of slightly varying diameter such that they overlap slightly when they are connected together by the middle expansion joint 13. The middle expansion joint 13 is located over the space 29 between the two barges provided for by the coupling member 33 in order to best accommodate the variable movement of the barges 3, 5 and, thereby, the equipment 25, 27. The middle expansion joint 13, furthermore, is designed to seal the connection between the two rigid, hollow duct segments 23*a*, 23*b*, while allowing a certain amount of variable movement between them. In a preferred embodiment, the middle expansion joint 13 is a fabric belt type expansion joint made of fluorinated elastoplastic, fluoroplastic or fluorelastomer materials. The contemplated potential relative movement between the barges allowed by the coupling member 33 is 2" horizontal and 2° relative longitudinal trim rotation, as measured at the joint member 11. The middle expansion joint 13 is selected from commercially available expansion joints which are manufactured in different widths. The required width depends directly on the amount of movement and thermal expansion to be accommodated by the middle expansion joint 13. Generally, the wider the expansion joint is, the more expensive. Here, a 12" wide expansion joint is sufficient to accommodate the above-mentioned variable motion of the barges and thus the duct segments 23*a*, 23*b*. However, different variable motion will require analysis of the required expansion joint size. Those skilled in the art will readily be able to determine the expansion joint size which will accommodate the needs of the system based on the maximum relative motion and thermal expansion allowed.

The ends of the duct segments 23*a*, 23*b* not joined together by the middle expansion joint 13, are hereinafter referred to as the distal ends of the conduit 23. When in use, the distal ends of the conduit 23 are connected to the pieces of equipment 25, 27 to and from which fluids are being conducted. For example, as shown in FIG. 1, one distal end of the conduit 23 is connected to the combustion turbine 27 (not shown) through a turbine exhaust stack outlet 28. A second expansion joint 17 connects that distal end of the conduit 23 to the turbine exhaust stack outlet 28. The second expansion joint 17 is designed to accommodate the thermal expansion and thermal movement of the combustion turbine duct segment 23*a* and the turbine exhaust stack outlet 28. The thermal expansion of the combustion turbine duct segment 23*a* results from the duct segment heating up from ambient temperature to full operating temperature (around 1000° F.) within thirty minutes. The thermal movement of adjacent components connecting the duct segment 23*a* to the turbine exhaust stack outlet 28 can be up to 1 inch. The second expansion joint 17, therefore, acts to seal the connection between the duct segment 23*a* and the turbine exhaust stack outlet 28 in addition to accommodating this thermal movement. The second expansion joint 17 must be chosen so that it accommodates the variations in thermal conditions, including thermal growth of potentially 0.25" at the turbine exhaust stack outlet 28. Again, based on commercially available units, the expansion joint 17 sufficient to accommodate these thermal variables is 12" wide. The composition of the second expansion joint 17 is basically the same as the middle expansion joint 13, i.e. a fluorinated elastoplastic, fluoroplastic or fluorelastomer fabric belt. Again, those skilled in the art will be readily able to determine the expansion joint size required to accommodate different parameters relating to thermal movement and growth.

Finally, the other distal end of the conduit 23 is connected to the HRSG 25 through the HRSG inlet opening 26 via the HRSG inlet port 24. A third expansion joint 15 completes this connection. The third expansion joint 15, like the second expansion joint 17, must primarily accommodate thermal expansion and movement, as opposed to the middle expansion joint 13, which must accommodate the relative movement of the barges allowed by the coupling member 33. The third expansion joint 15 is made of the same material as the other two, and the thermal movement allowed is approximately 2". Therefore, again, a 12" wide expansion joint is sufficient to accomplish the desired function. Again, those skilled in the art will be able to determine the expansion joint size required to accommodate different parameters relating to thermal movement.

Finally, the conduit 23 must be supported by support members on both barges. For example, there is one support member 19 on the simple cycle barge 5 and one support member 21 on the combined cycle barge 3. The particular type of support member used on each barge in the preferred embodiment is shown in more detail in FIGS. 2–4. In general, the support members 19, 21 can be any rigid structure capable of physically supporting the conduit 23 above the upper surface of each of the barges and holding it fixedly above the barge. The support members 19, 21, however, must allow for some expansion of the conduit 23 resulting from the change in thermal conditions.

Figure 2:
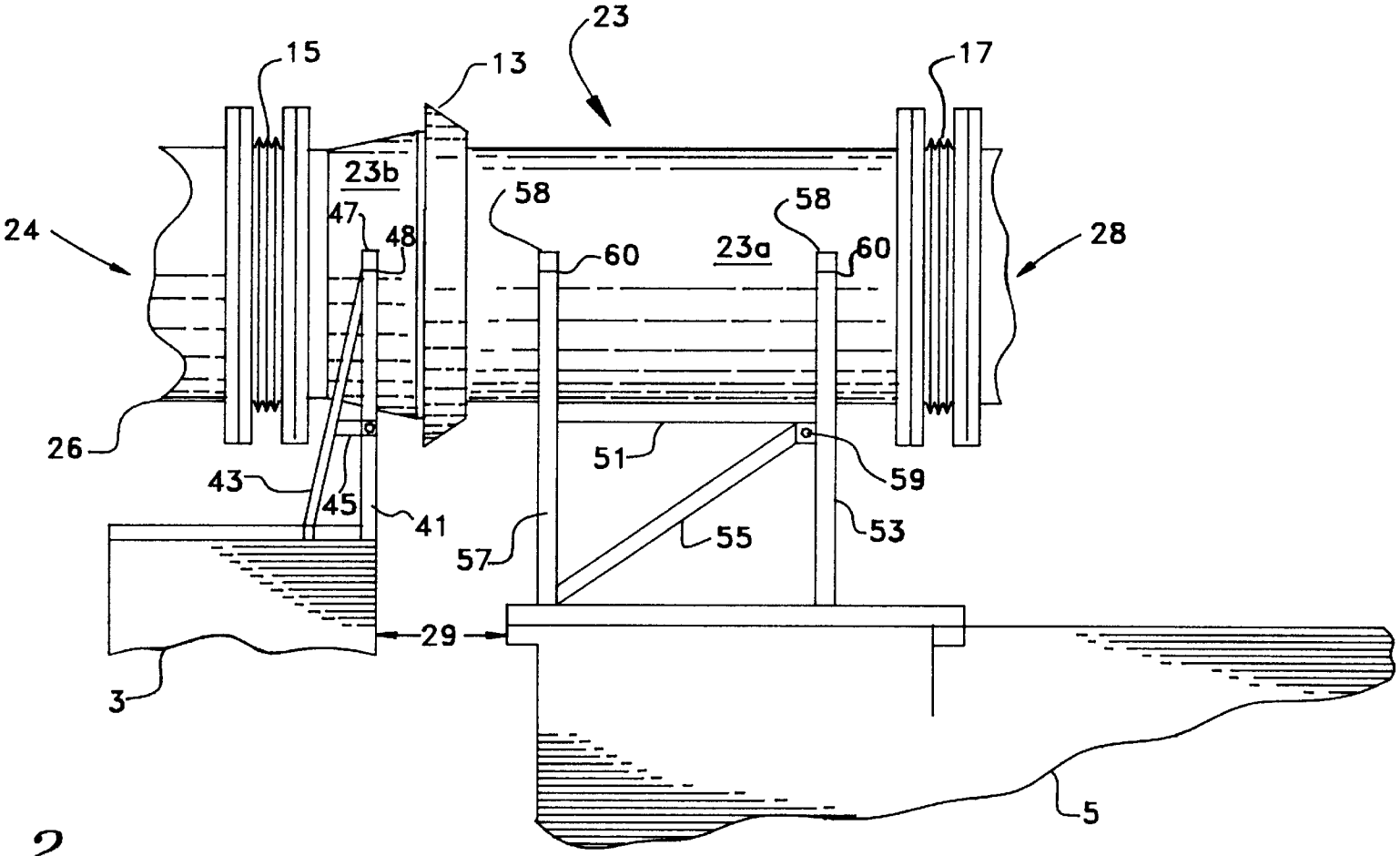
FIG. 2 schematically illustrates more details of the invention, specifically, conduit, expansion joints, and support structure used in the practice of the invention.

Referring now to FIG. 2, the same embodiment of the present invention is shown, with emphasis on the support members and the conduit 23, including the various connections made by the expansion joints 13, 15 and 17. The simple cycle barge 5 and combined cycle barge 3 are shown with the space 29 between them being spanned by the conduit 23. Again, the middle expansion joint 13 is located in the middle of the space 29, in order to best accommodate the relative movement of the two barges. The second expansion joint 17 provides the connection between the conduit 23, more particularly the combustion turbine duct segment 23*a,* and the combustion turbine exhaust stack outlet 28. The exhaust stack outlet 28 allows the conduit 23 to conduct fluids out of the combustion turbine 27 (not shown). On the combined cycle barge 3, the third expansion joint 15 again provides the connection between the conduit 23, more particularly the HRSG duct segment 23*b,* and the HRSG inlet opening 26 through the HRSG inlet port 24. Similarly, the HRSG inlet port 24 allows the conduit 23 to conduct fluids into the HRSG 25 (not shown) on the combined cycle barge 3.

A preferred embodiment for the support structures is shown, wherein one A-frame type support is used on the combined cycle barge 3, and two brace frame type supports are used on the simple cycle barge 5. The exact configuration of the support structures in the preferred embodiment is primarily a function of the available space for the structure on the barge deck. The combined cycle barge 3 contains the steam turbine and the HRSG 25, which are considerably larger than the combustion turbine 27 located on the simple cycle barge 5. Thus, the A-framed support member on the combined cycle barge 3 must accommodate the load of the HRSG duct segment 23*b,* including all dead, thermal and wind loads as well as the longitudinal unbalanced pressure force resulting from the change in diameter of the duct at the middle expansion joint 13, and any fluids being conducted. A frontal view of the A-frame support structure, as seen from the middle expansion joint 13, is given in FIG. 3, described in more detail below. A frontal view of the two brace frame support structure, as seen from the middle expansion joint 13, is given in FIG. 4, also described in more detail below. For each element of the support structure shown in FIG. 2, there is an identical element located on the opposite side of the conduit 23, as can be seen more clearly in FIGS. 3 & 4.

Referring again to FIG. 2, to satisfy the support requirements of the HRSG duct segment 23*b,* the A-frame support member consists of a first leg 41 with one end affixed to the combined cycle barge 3 and the other end attached to the HRSG duct segment 23*b* by a bracket 47. The vertical support of the HRSG duct segment 23*b* is provided exterior to the conduit 23 at its horizontal centerline by the bracket 47. A horizontal slide plate 48 is attached to the conduit end of the first leg 41 and to the bracket 47. The horizontal slide plate 48 is affixed to the HRSG duct segment 23*b* at approximately its horizontal centerline and provides for any radial expansion in the HRSG duct segment 23*b*. A bracing leg 43 is affixed to the first leg 41 at the bracket 47. Finally, a horizontal leg 45 is affixed to the first leg 41 and to the bracing leg 43 to provide the required support.

Figure 3:
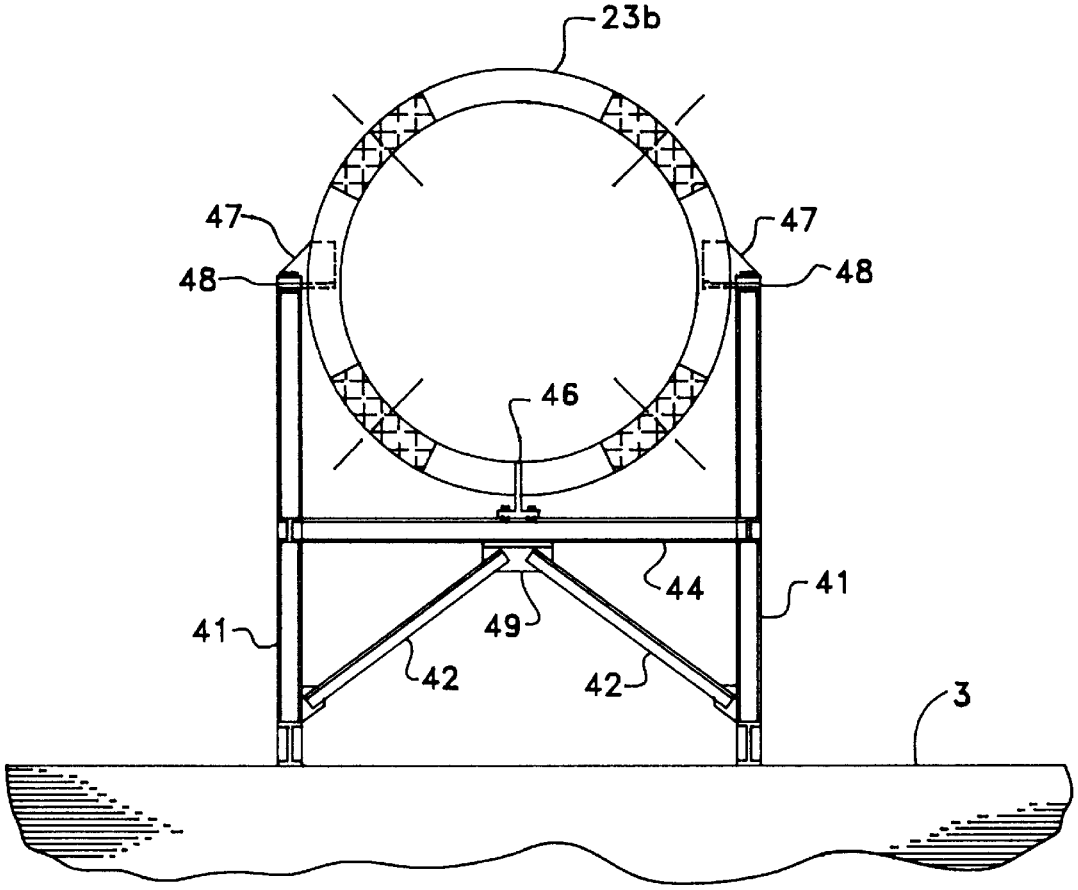
FIG. 3 is a front view of a conduit and support structure for use in the present invention.

Referring now to FIG. 3, the combined cycle barge 3 support structure is shown in a frontal view, as seen from the middle expansion joint 13. Again, the first legs 41 are rigidly affixed to the barge and connected to the HRSG duct segment 23*b* at about its horizontal centerline by the brackets 47 to provide the vertical support. Lateral loads transverse to the HRSG duct segment 23*b* are resisted with a lateral restraint 46 below the HRSG duct segment 23*b* at its vertical centerline. The lateral restraint 46 is designed to provide free movement created by the radial expansion (downward) of the HRSG duct segment 23*b*. The lateral restraint 46 is supported by a cross beam 44. Further support is provided by two brace legs 42 which are affixed to the cross beam 44 by a bracket 49. The brace legs are also rigidly affixed to the vertical first legs 41 slightly above the barge 3 deck. Axial restraint for the HRSG duct segment 23*b* is established at both the horizontal centerline brackets 47 and the lateral restraint 46. Therefore, the full support requirements for the HRSG duct segment 23*b* are met while allowing for thermal movement and growth.

Referring again to FIG. 2, to satisfy the support requirements of the combustion turbine duct segment 23*a,* the two brace frame support members allow for fixing the combustion turbine duct segment 23*a* on one side by one of the brace framed support members while permitting for thermal longitudinal growth at the other brace-framed support member. The brace frame support members each comprise two parallel, vertical legs 53, 57 affixed to the simple cycle barge 5 and positioned perpendicular to the length of the combustion turbine duct segment 23*a*. Each brace frame support member also possesses a cross leg 55 attached at the lower end of the leg 57 closest to the middle expansion joint 13 and to the other leg 53 by a bracket 59 below the lower surface of the combustion turbine duct segment 23*a*. Finally, a horizontal brace beam 51 is affixed to each of the parallel, vertical legs 53, 57 again below the lower surface of the combustion turbine duct segment 23*a*. Each of the parallel, vertical legs 53, 57 is affixed to the combustion turbine duct segment 23*a* at approximately its horizontal centerline by brackets 58. These connections provide the vertical support of the combustion turbine duct segment 23*a*. Again, horizontal slide plates 60 are attached to the parallel, vertical legs 53, 57 on the ends that are affixed to the duct segment 23*a* by the bracket 58. The horizontal slide plates 60 are also directly connected to the brackets 58. These horizontal slide plates 60 provide for any radial expansion in the combustion turbine duct segment 23*a*.

Figure 4:
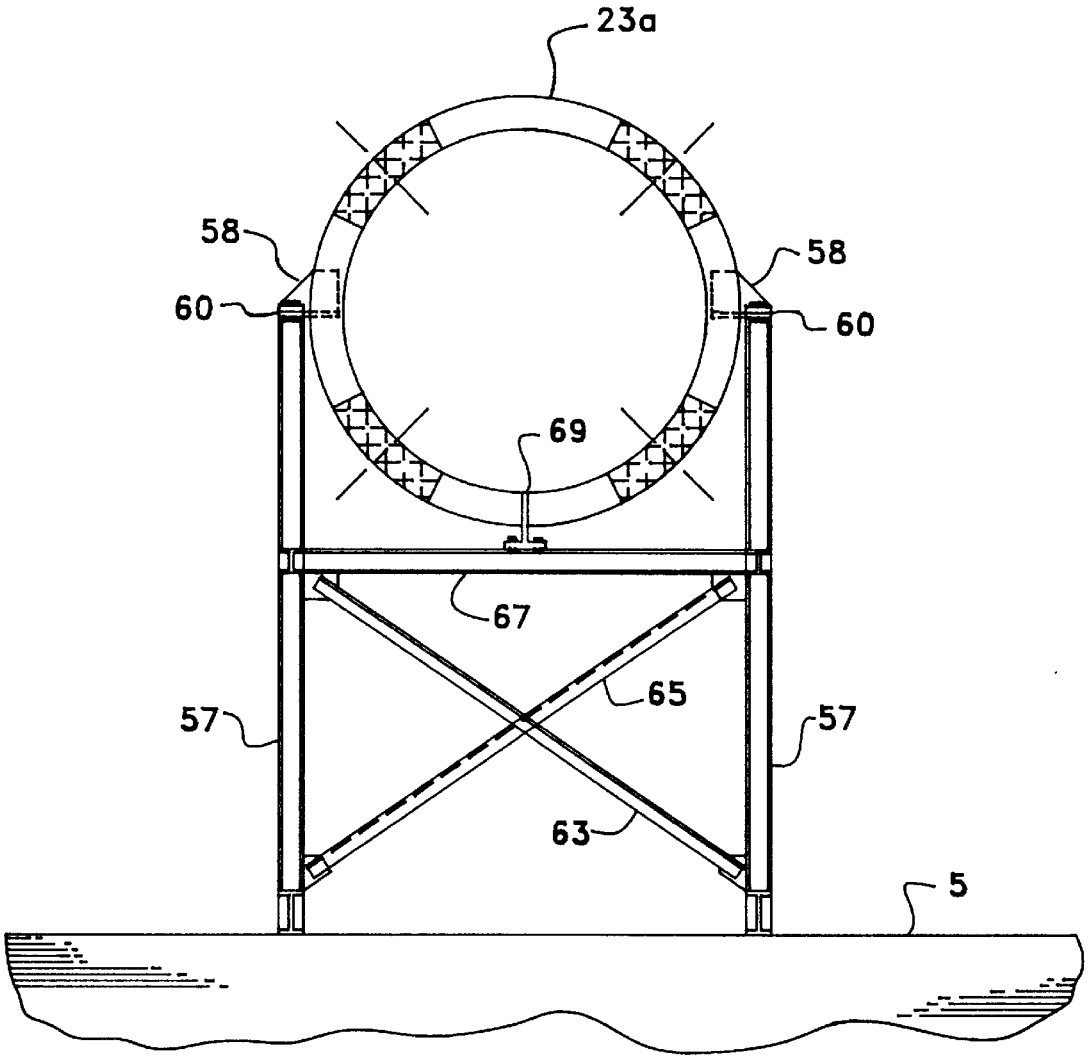
FIG. 4 is another front view of a conduit and support structure for use in the present invention.

Referring now to FIG. 4, the simple cycle barge 5 support is shown in a frontal view, as seen from the middle expansion joint 13. Again, the parallel, vertical legs 53 (not shown), 57 are rigidly affixed to the barge 5 and connected to the combustion turbine duct segment 23*a* at about its horizontal centerline by the brackets 58 to provide the vertical support. Radial expansion is accommodated by the horizontal slide plates 60. Lateral loads transverse to the combustion turbine duct segment 23*a* are resisted with a lateral restraint 69 below the combustion turbine duct segment 23*a* and at its vertical centerline. The lateral restraint 69 is designed to provide free movement created by the radial expansion (downward) of the combustion turbine duct segment 23*a*. The lateral restraint 69 is supported by a cross beam 67. Further support for both the cross beam 67 and the parallel, vertical legs 53 (not shown), 57 is provided by cross-brace legs 63, 65. FIG. 4 displays the connection of the two cross-brace legs 63, 65 to the two vertical legs 57, which are located closest to the middle expansion joint 13. As can be seen, each of the cross-brace legs is rigidly connected to one of the vertical legs 57 at a lower end and the other vertical leg 57 at the upper end, such that the cross-brace legs 63, 65 form an X-shape between the two vertical legs 57. An identical configuration of support is located between the other two vertical legs 53 (not shown). Axial restraint for the combustion turbine duct segment 23*a* is provided at the bracket 58 and at the lateral restraints 69 at the legs 57 closest to the middle expansion joint 13. The bracket 58 and lateral restraint 69 at the legs 53 further from the middle expansion joint 13 resist only vertical and transverse forces respectively. This support arrangement also provides for the longitudinal thermal expansion of the combustion turbine duct segment 23*a*.

Now referring to FIG. 5, the coupling member 33 of the present invention is disclosed in more detail. As discussed above, the coupling member 33 serves to connect the facing ends of the floating vessels together so that the conduit 23 may conduct fluids from equipment located on one vessel to equipment located on the other. The coupling member 33, therefore, limits the range of movements that must be accommodated by the expansion joint 13 connecting the two segments of the conduit 23 together, in the preferred embodiment.

The coupling member 33 in FIG. 5 is the same as that described in connection with FIG. 1. As shown in FIG. 5, there is another, identical coupling member 33 coupling the opposite corners of the facing ends of the two barges together. FIG. 5 also discloses a less preferred embodiment of the conduit 23' and the support members 19, 21 of the present invention. In this embodiment, the conduit 23' is one rigid, hollow duct with no middle expansion joint to accommodate the relative movement of the vessels. The support members 19, 21, therefore, must accomplish the task of preventing the relative movement of the vessels 3, 5 from applying excessive stress on the rigid conduit 23'. The support members 19, 21 (on FIG. 1) must, therefore, act as flexible supports to accommodate the relative change in trim between the two barges, keep the elevation of the conduit 23 essentially fixed with respect to the locations of the turbine exhaust stack outlet 28 and the HRSG inlet opening 26, and to resist the lateral wind loads.

As shown in FIG. 5, these features of the support members of this embodiment are accomplished by using different type supports at each of four locations on the conduit 23'. In FIG. 5, using marine terminology, the direction of flow through the conduit 23' is defined to be forward (left to right as shown in FIG. 5). This provides a basis for forward and aft end and port and starboard side terminology.

The conduit 23' support system, in the embodiment of FIG. 3, uses braced columns and struts for its legs. The aft starboard support structure 71 has a first leg 73 which is welded to the barge deck and braced fore and aft and athwartship by two other legs 75, 77 which are also welded to the barge deck. The first leg 73 is then attached to the aft starboard side of the conduit 23' by a rod-end bearing 79. At installation, the conduit 23' is aligned with the equipment at its inlet end 81 and offset to starboard by an amount equal to the radial thermal growth of the conduit 23'. This positions the conduit flange and holds it rigidly in the fore, aft, and athwartship directions with respect to the barge deck. Fixing it in this manner isolates the inlet expansion joint 83 from any conduit 23' axial thermal growth.

The aft port support leg 85 is attached to the barge deck by a rod-end bearing 87, and to the aft port side of the conduit 23' by a rod-end bearing 89. Use of left and right hand rod-end bearings permits the port support leg 85 length to be adjusted to align the conduit 23' vertically. This fixes the aft end of the conduit 23' in the vertical direction while permitting rotation of the conduit 23' about the vertical and athwartship axes.

The forward port support leg 91 is braced in the athwartship direction with one end of the leg and brace hinged 93 just above the barge deck to permit rotation about the athwartship axis. The other end of the forward port support leg 91 is attached to the forward port side of the conduit 23' by a rod-end bearing 95. The forward port support leg 91 is positioned to align the conduit 23' with the equipment at its outlet end 97 and offset to port by an amount equal to the radial thermal growth of the conduit 23'. This completes the necessary and sufficient set of three fixed length supports and braces to provide the conduit 23' with a dynamically rigid support system while simultaneously permitting free thermal growth and barge movement.

The forward starboard support leg 99 is attached to a barge deck-mounted variable spring pipe support 101 at one end and to the forward starboard side of the conduit by a rod-end bearing 103 at the other end. The spring pipe support 101 is adjusted to align the conduit 23' vertically and offset to port such that the forward starboard support leg 99 will be in the vertical plane at normal operating temperatures. The spring pipe support 101 is adjusted such that it provides an upward force equal to one half of the weight acting at the forward end of the conduit 23' plus one fourth of the weight of the forward expansion joint 105.

Thus, the support structure shown in FIG. 5 also accomplishes the goals of the present invention and eliminates the need for the middle expansion joint 13 of the preferred embodiment, shown in FIGS. 1 & 2. The conduit 23' still conducts fluids from equipment on one floating vessel to equipment on the other, but in this embodiment, the variable movement of the vessels and the thermal variables relating to the conduit 23' are accommodated by the various legs of the support structure.

While the invention has been described and illustrated with reference to specific embodiments, those skilled in the art will recognize that modification and variations may be made without departing from the principles of the invention as described hereinabove and set forth in the following claims.

What is claimed is:

1. An assembly for connecting at least two marine vessels and conducting fluids between the vessels, said assembly comprising:

a coupling member with high moment loading capabilities, adapted to be affixed to facing ends of the vessels for pivotably coupling the facing ends of the vessels together permitting free rotational movement but controlled translational movement of each vessel relative to the other, such that, when in use with the vessels, the coupling member, traverses a space between the vessels;

a rigid conduit for conducting the fluids between the vessels, such that, when in use with the vessels, the conduit traverses the space between the vessels; and support members adapted to be affixed to each vessel for supporting opposing ends of the conduit on the vessels.

2. The assembly of claim 1 wherein the coupling member comprises:

at least one pair of rigid legs with high moment loading capabilities, each leg having one end adapted to be attached to a different one of the vessels, and a free end; and at least one joint member pivotably connecting the free end of each leg for permitting free rotational movement but controlled translational movement of each vessel relative to the other.

3. The assembly of claim 1 wherein the conduit comprises:

at least two hollow ducts; and at least one expansion joint connecting the ducts together for preventing movement of the vessels from applying stress on the hollow ducts.

4. The assembly of claim 3 wherein there is a plurality of expansion joints and wherein at least one of the expansion joints is, when in use with the vessels, positioned over the space between the vessels.

5. The assembly of claim 4 wherein the support members comprise:

a first fixed support structure affixed to one of the vessels and one end of the conduit; and a second fixed support structure affixed to the other of the vessels and the other end of the conduit.

6. The assembly of claim 5 wherein the first fixed support structure comprises at least two brace-framed type supports, and the second fixed support structure comprises an A-frame type support structure.

7. The assembly of claim 1 wherein the coupling member comprises:

two pair of rigid legs each with high moment loading capabilities, each leg of each of the two pair having one end, adapted to be attached to a corner of the facing ends of the vessels, and a free end; and two joint members connecting the free end of each leg for permitting free rotational movement but controlled translational movement of each vessel relative to each other.

8. The assembly of claim 7 wherein the two joint members connecting the free end of each leg are adapted to be elevated above an upper surface of each of the vessels and laterally even with the level of the conduit above the vessels.

9. The assembly of claim 1 wherein the support members comprise:

a first absorbing support structure adapted to be disposed on one of the vessels, wherein the first absorbing support structure prevents movement of the vessels from applying stress on the dynamically rigid conduit; and a second absorbing support structure adapted to be disposed on the other of the vessels, wherein the second absorbing support structure prevents movement of the vessels from applying stress on the dynamically rigid conduit.

10. A multi-vessel ducting assembly comprising:

at least two anchored marine vessels having facing ends located in close proximity to each other;

a fluid repository disposed on each of the vessels;

a coupling member with high moment loading capabilities, affixed to facing ends of the vessels for pivotably coupling the facing ends of the vessels together permitting free rotational movement but controlled translational movement of each vessel relative to the other, such that the coupling member traverses a space between the vessels;

a rigid conduit for conducting fluids between the repository on each vessel, said conduit having one end engaging a port in one repository and the other end engaging a port in the other repository, such that the conduit traverses the space between the vessels; and support members affixed to each vessel for supporting opposing ends of the conduit on the vessels.

11. The multi-vessel ducting assembly of claim 10 wherein the anchored marine vessels are moored barges.

12. The multi-vessel ducting assembly of claim 10 wherein there are two vessels and two repositories and, wherein one of the repositories is a combustion turbine and the other of the repositories is a heat recovery steam generator.

13. The multi-vessel ducting assembly of claim 10 wherein the coupling member comprises:

at least one pair of rigid legs with high moment loading capabilities, each leg having one end attached to a different one of the vessels, and a free end; and at least one joint member pivotably connecting the free end of each leg for permitting free rotational movement but controlled translational movement of each vessel relative to the other.

14. The multi-vessel ducting assembly of claim 10 wherein the rigid conduit comprises:

at least two hollow ducts; and at least one expansion joint connecting the ducts together, for preventing movement of the vessels from applying stress on the hollow ducts.

15. The multi-vessel ducting assembly of claim 14 wherein there is a plurality of expansion joints and wherein at least one of the expansion joints is positioned over the space between the vessels.

16. The multi-vessel ducting assembly of claim 10 further comprising:

a second coupling member affixed to facing ends of the vessels for pivotably coupling the facing ends of the vessels together, such that the second coupling member traverses the space between the vessels.

17. The multi-vessel ducting assembly of claim 16 wherein the rigid conduit comprises:

at least two hollow ducts; and at least one expansion joint connecting the ducts together for preventing movement of the vessels from applying stress on the two hollow ducts.

18. The multi-vessel ducting assembly of claim 17 wherein the support members comprise:

a first fixed support structure affixed to one of the vessels and one end of the conduit; and a second fixed support structure affixed to the other of the vessels and the other end of the conduit.

19. The multi-vessel ducting assembly of claim 18 wherein the first fixed support structure comprise at least two brace-framed type supports, and the second fixed support structure comprises an A-frame type support structure.

20. A method of conducting fluids between two marine vessels comprising the steps of:

arranging the vessels so that ends thereof face each other;

affixing one end of a first leg to a facing end of a first vessel, the first leg having a free end;

affixing one end of a second leg to a facing end of a second vessel, the second leg having a free end;

pivotably joining the free ends of the first and second legs together so as to permit the vessels to freely and rotationally move in a controlled translational manner relative to each other, and such that the legs traverse a space between the vessels;

placing a rigid conduit with two ends across the space between the vessels;

placing one end of the rigid conduit in fluid communication with a first repository located on the first vessel;

placing the other end of the rigid conduit in fluid communication with a second repository located on the second vessel;

supporting the rigid conduit fixedly above an upper surface of each of the vessels; and flowing fluid from the first repository to the second repository through the conduit.

21. The method of claim 20 comprising the additional steps of:

affixing one end of a third leg to the facing end of the first vessel such that the third leg is separated from the first leg, the third leg having a free end;

affixing one end of a fourth leg to the facing end of the second vessel such that the fourth leg is separated from the second leg, the fourth leg having a free end;

pivotably joining the free ends of the third and fourth legs together so as to permit the vessels to freely and rotationally move in a controlled translational manner relative to each other and such that the third and fourth legs traverse the space between the vessels.

* * * * *